US009938884B2

(12) United States Patent
Li et al.

(10) Patent No.: US 9,938,884 B2
(45) Date of Patent: Apr. 10, 2018

(54) VEHICLE HAVING A COOLING SYSTEM FOR COOLING AN ENGINE AND A GENERATOR

(71) Applicant: Kwang Yang Motor Co., Ltd., Kaohsiung (TW)

(72) Inventors: Wei-Chung Li, Ka (TW); Wen-Tso Cheng, Kaohsiung (TW); Sai-Dai Yang, Ka (TW)

(73) Assignee: Kwang Yang Motor Co., Ltd., Kaohsiung (TW)

( * ) Notice: Subject to any disclaimer, the term of this patent is extended or adjusted under 35 U.S.C. 154(b) by 494 days.

(21) Appl. No.: 14/602,690

(22) Filed: Jan. 22, 2015

(65) Prior Publication Data

US 2015/0211411 A1 Jul. 30, 2015

(30) Foreign Application Priority Data

Jan. 29, 2014 (TW) ..... 103103551 A

(51) Int. Cl.
*F01P 3/12* (2006.01)
*F01P 7/16* (2006.01)
*F01P 3/20* (2006.01)

(52) U.S. Cl.
CPC ..... *F01P 7/164* (2013.01); *F01P 3/12* (2013.01); *F01P 7/162* (2013.01); *F01P 3/20* (2013.01)

(58) Field of Classification Search
CPC ..... F01P 3/12; F01P 3/18; F01P 5/10; F01P 5/12; F01P 7/164; F01P 7/162; F01P 3/20
See application file for complete search history.

(56) References Cited

U.S. PATENT DOCUMENTS 4,648,359 A * 3/1987 Ito ..... F01L 1/02 123/192.2
2010/0044013 A1* 2/2010 Kim ..... F28D 1/0435 165/104.21
2010/0116458 A1* 5/2010 Kim ..... F01P 3/18 165/41
2012/0318214 A1* 12/2012 Iwai ..... F01P 11/16 123/41.15

* cited by examiner

*Primary Examiner* — Jacob Amick
(74) *Attorney, Agent, or Firm* — Husch Blackwell LLP

(57) ABSTRACT

A vehicle includes: an engine including cylinder, a piston, a crankshaft unit, a balancing shaft unit, and an engine cooling passage; a power generating system including a generator and a generator cooling passage; and a cooling system that includes a mechanical water pump driven by the crankshaft unit, a first heat exchanger in fluid communication with the mechanical water pump and the engine cooling passage to constitute a first cooling circuit, an electrically controlled water pump, a second heat exchanger in fluid communication with the electrically controlled water pump and the generator cooling passage to constitute a second cooling circuit, and a controlling unit for controlling operation of the electrically controlled water pump.

9 Claims, 5 Drawing Sheets

VEHICLE HAVING A COOLING SYSTEM FOR COOLING AN ENGINE AND A GENERATOR

CROSS-REFERENCE TO RELATED APPLICATION

This application claims priority of Taiwanese Patent Application No. 103103551, filed on Jan. 29, 2014, the entire disclosure of which is hereby incorporated by reference.

FIELD OF THE INVENTION

This invention relates to a vehicle, more particularly to a vehicle having a cooling system for cooling an engine and a generator.

BACKGROUND OF THE INVENTION

Referring to FIG. 1, a conventional vehicle includes an engine 2, a generator 3 and a cooling system 1 for cooling the engine 2 and the generator 3. The engine 2 includes cylinder 21, a piston 22 that is capable of moving upwardly and downwardly in the cylinder 21, a crankshaft 23 that is driven by the piston 22, and a rotating shaft 24 that is driven by the crankshaft 23. The cooling system 1 includes a water pump 11 that is driven by the rotating shaft 24 and a heat exchanger 12 that is in fluid communication with the engine 2 and the water pump 11 so as to constitute a cooling circuit.

During the cooling process, the cooling water that flows through the engine 2 and that has been heated up by the engine 2 is transported through the water pump 11 into the heat exchanger 12 so as to be cooled down again and reflow into the engine 2 to achieve a cooling cycle.

If the generator 3 is a large-size power generating device that also provides electricity to an external electrical appliance, the generator 3 needs to be cooled down. However, the optimum working temperatures of the engine 2 and the generator 3 are different. Since the cooling system 1 includes only one water pump 11 and the heat exchanger 12 can only provide a single temperature of the cooling water, the engine 2 and the generator 3 cannot be cooled down independently. Furthermore, the water pump 11 is mechanically driven by the engine 2, and the turn-on time and the turn-off time of the water pump 11 can only be controlled by the operation time of the engine 2, so that cooling efficiency of the cooling system 1 is not optimized, thereby resulting in power loss of the engine 2 and increasing the load of the engine 2.

SUMMARY OF THE INVENTION

Therefore, an object of the present invention is to provide a vehicle that can overcome the aforesaid drawbacks of the prior art.

According to this invention, a vehicle includes an engine, a power generating system and a cooling system. The engine includes cylinder, a piston that is capable of moving upwardly and downwardly in the cylinder, a crankshaft unit that is driven by the piston, a balancing shaft unit that is driven by the crankshaft unit, and an engine cooling passage that is for cooling water to flow through. The power generating system includes a generator and a generator cooling passage. The cooling system includes a mechanical water pump, a first heat exchanger, an electrically controlled water pump, a second heat exchanger and a controlling unit. The mechanical water pump is driven by the crankshaft unit and is in fluid communication with the engine cooling passage. The first heat exchanger is in fluid communication with the mechanical water pump and the engine cooling passage to constitute a first cooling circuit. The electrically controlled water pump is in fluid communication with the generator cooling passage. The second heat exchanger is in fluid communication with the electrically controlled water pump and the generator cooling passage to constitute a second cooling circuit. The controlling unit is electrically connected to the electrically controlled water pump and the generator to control operation of the electrically controlled water pump.

BRIEF DESCRIPTION OF THE DRAWINGS

Other features and advantages of the present invention will become apparent in the following detailed description of the embodiment of this invention, with reference to the accompanying drawings, in which.

DETAILED DESCRIPTION OF THE EMBODIMENT

A vehicle according to the present invention is, for example but not limited to a two-wheel or four-wheel vehicle, such as a motorcycle or an all terrain vehicle.

Figure 1:
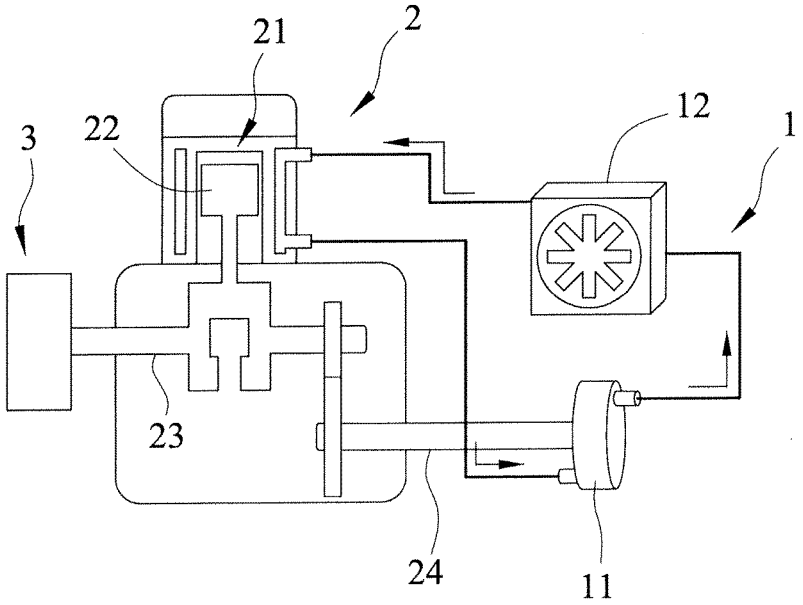
FIG.1 PRIOR ART
FIG. 1 is a schematic view of a cooling system of a conventional vehicle.
Figure 2:
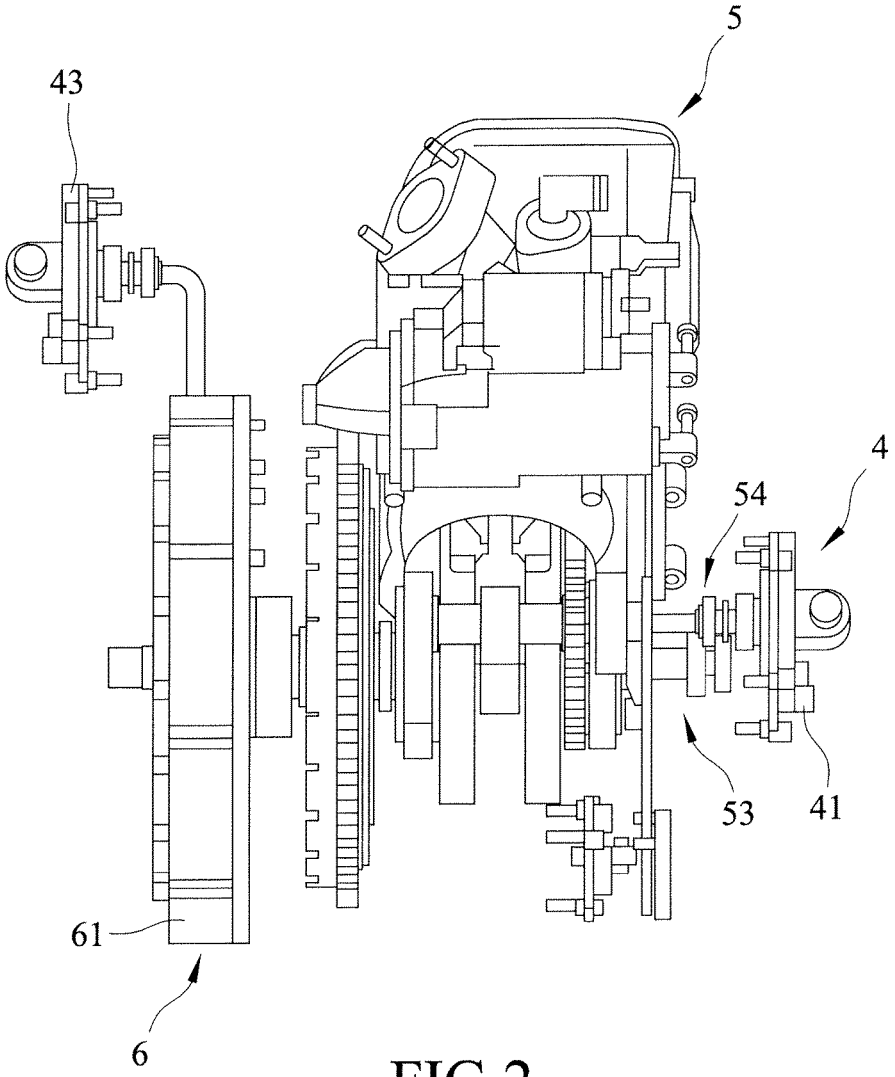
FIG. 2 is a side view of a cooling system of the embodiment of a vehicle according to this invention.
Figure 3:
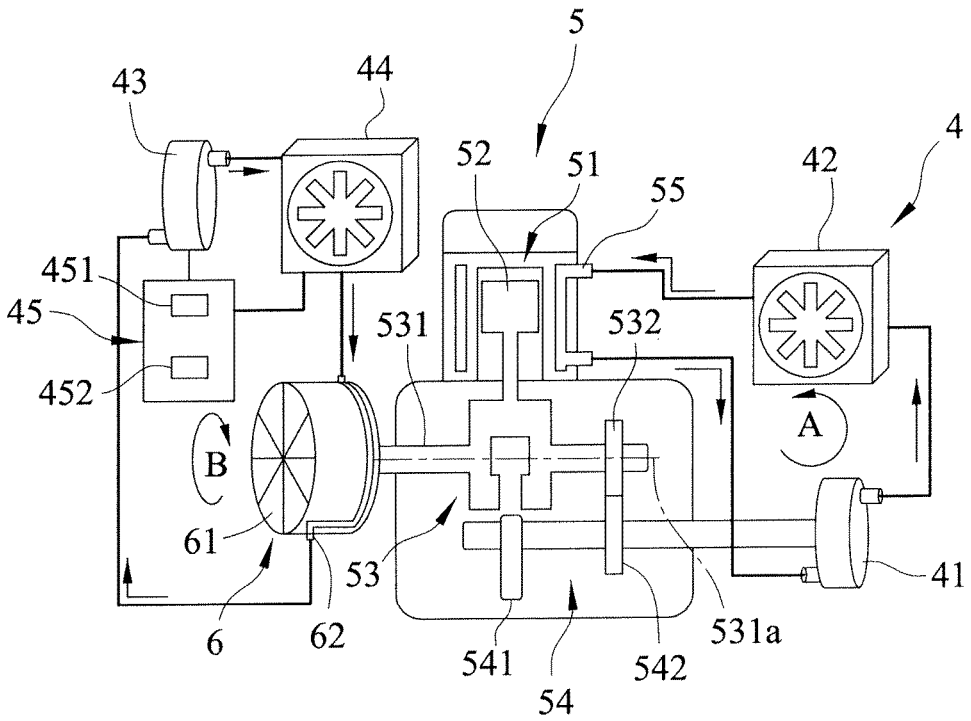
FIG. 3 is a schematic view of the cooling system of the embodiment.

Referring to FIGS. 2 and 3, the embodiment of a vehicle according to the present invention includes an engine 5, a power generating system 6 and a cooling system 4.

The power generating system 6 includes a generator 61 and a generator cooling passage 62 for cooling water to flow through.

The engine 5 includes cylinder 51, a piston 52 that is capable of moving upwardly and downwardly in the cylinder 51, a crankshaft unit 53 that is driven by the piston 52, a balancing shaft unit 54 that is driven by the crankshaft unit 53, and an engine cooling passage 55 that is for cooling water to flow through. The crankshaft unit 53 includes a crankshaft 531 and a first gear 532 that is fixedly sleeved on the crankshaft 531. The generator 61 is driven by the crankshaft 531. The balancing shaft unit 54 includes a balancing shaft 541 and a second gear 542 that is fixedly sleeved on the balancing shaft 541 and that meshes with the first gear 532. In this embodiment, a tooth number of the first gear 532 is the same as that of the second gear 542 so that the rotational speed of the balancing shaft 541 is the same as that of the crankshaft 531.

The cooling system 4 is for cooling the engine 5 and the generator 61, and includes a mechanical water pump 41, a first heat exchanger 42, an electrically controlled water pump 43, a second heat exchanger 44 and a controlling unit 45.

The mechanical water pump 41 is driven by the crankshaft unit 53 and is in fluid communication with the engine cooling passage 55. The first heat exchanger 42 is in fluid communication with the mechanical water pump 41 and the engine cooling passage 55 to constitute a first cooling circuit (A). The electrically controlled water pump 43 is in fluid communication with the generator cooling passage 62. The second heat exchanger 44 is in fluid communication with the electrically controlled water pump 43 and the generator cooling passage 62 to constitute a second cooling circuit (B). The controlling unit 45 is electrically connected to the electrically controlled water pump 43 and the generator 61 to control operation of the electrically controlled water pump 43.

In this embodiment, the presence of the balancing shaft 541 results in a reduction in the vibration of the crankshaft 531. Moreover, the cooling water pumped by the mechanical water pump 41 can also absorb the vibration of the balancing shaft 541 and the vibration between the first and second gears 532, 542, thereby reducing noise between the gears.

The optimum working temperature of the engine 5 is about 70 to 80° C. The optimum working temperature of the generator 61 is about 20 to 30° C., which is much lower than the optimum working temperature of the engine 5. If the temperature of the cooling water pumped into the engine 5 is too low, contraction of the cylinder 51 may occur so that the piston 52 may get stuck in the cylinder 51. If the temperature of the cooling water pumped into the generator 61 is too high, the cooling effect is not sufficient so that the generator 61 may burn.

In the first cooling circuit (A), the cooling water is transported by the mechanical water pump 41 to dissipate the heat generated from the engine 5. The cooling water that flows through the engine cooling passage 55 and that has been heated up by the engine 5 is then transported through the mechanical water pump 41 into the first heat exchanger 42 so as to be cooled down again and reflow into the engine cooling passage 55 to achieve a cooling cycle. In the second cooling circuit (B), the cooling water is transported by the electrically controlled water pump 43 to dissipate the heat generated from the generator 61.

The cooling water that flows through the generator cooling passage 62 and that has been heated up by the generator 61 is then transported through the electrically controlled water pump 43 into the second heat exchanger 44 so as to be cooled down again and reflow into the generator cooling passage 62 to achieve another cooling cycle. In this embodiment, since the operation of the mechanical water pump 41 and the electrically controlled water pump 43 are completely independent of each other, the mechanical water pump 41 and the electrically controlled water pump 43 can respectively and independently control the cooling water in the first and second cooling circuits (A, B) such that the engine 5 and the generator 61 can work at their optimum working temperature.

The crankshaft 531 has an axis 531*a*. The mechanical water pump 41 and the generator 61 are respectively disposed at two opposite sides of the crankshaft 531 along the axis 531*a* (see FIG. 3). The mechanical water pump 41 and the first heat exchanger 42 are disposed at a side of the engine 5, while the generator 61, the second heat exchanger 44 and the electrically controlled water pump 43 are disposed at an opposite side of the engine 5. Such an arrangement provides a better balance among weights of components of the vehicle, thereby increasing stability of the engine 5 and reducing noise and vibration during operation.

Referring to FIG. 3, the controlling unit 45 includes a controlling member 451 and a temperature sensing member 452 for detecting temperature of the generator 61 and emitting a temperature signal to the controlling member 451 so that the controlling member 451 is able to control turn-on time and turn-off time of the electrically controlled water pump 43 depending on the temperature signal. To be more specific, the electrically controlled water pump 43 will be turned on when the temperature of the generator 61 is raised up to a certain value. On the contrary, the electrically controlled water pump 43 will be turned off when the temperature of the generator 61 is cooled down to a certain value. Moreover, when the electrically controlled water pump 43 is turned on, the controlling member 451 further controls the rotational speed of the electrically controlled water pump 43 so as to adjust the flow rate of cooling water in the electrically controlled water pump 43.

Figure 4:
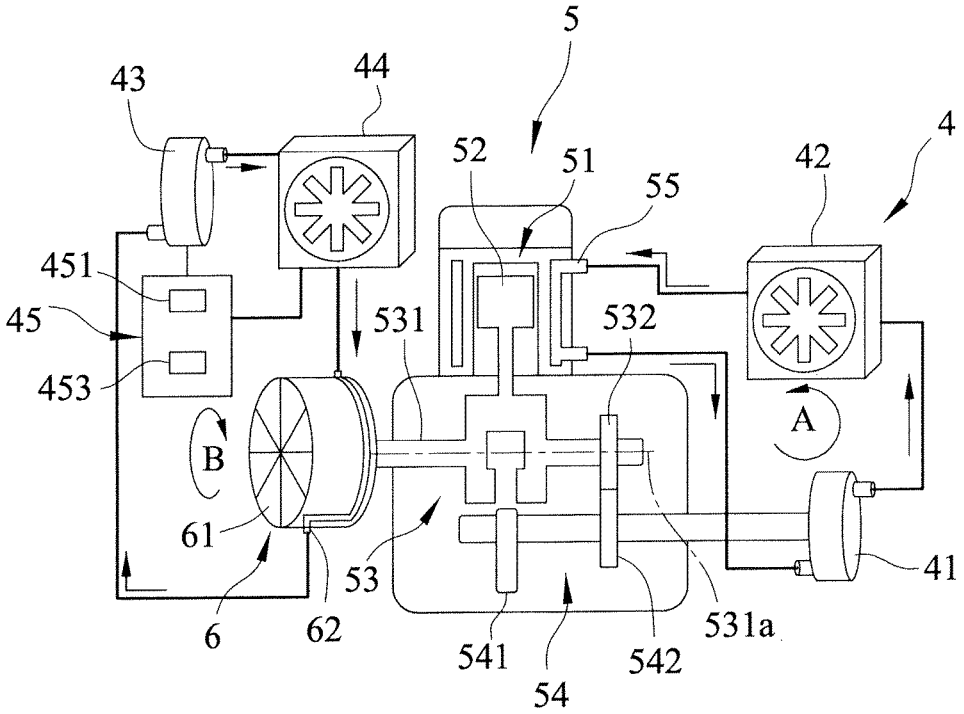
FIG. 4 is a schematic view of an variation of the cooling system of the embodiment.

FIG. 4 shows a variation of this embodiment. In this variation, the controlling unit 45 includes a controlling member 451 and a timer 453 for emitting a timing signal to the controlling member 451 according to the operation time of the generator 61 so that the controlling member 451 is able to control turn-on time and turn-off time of the electrically controlled water pump 43 depending on the timing signal. To be more specific, the electrically controlled water pump 43 will be turned on after a certain period of the operation time of the generator 61.

Figure 5:
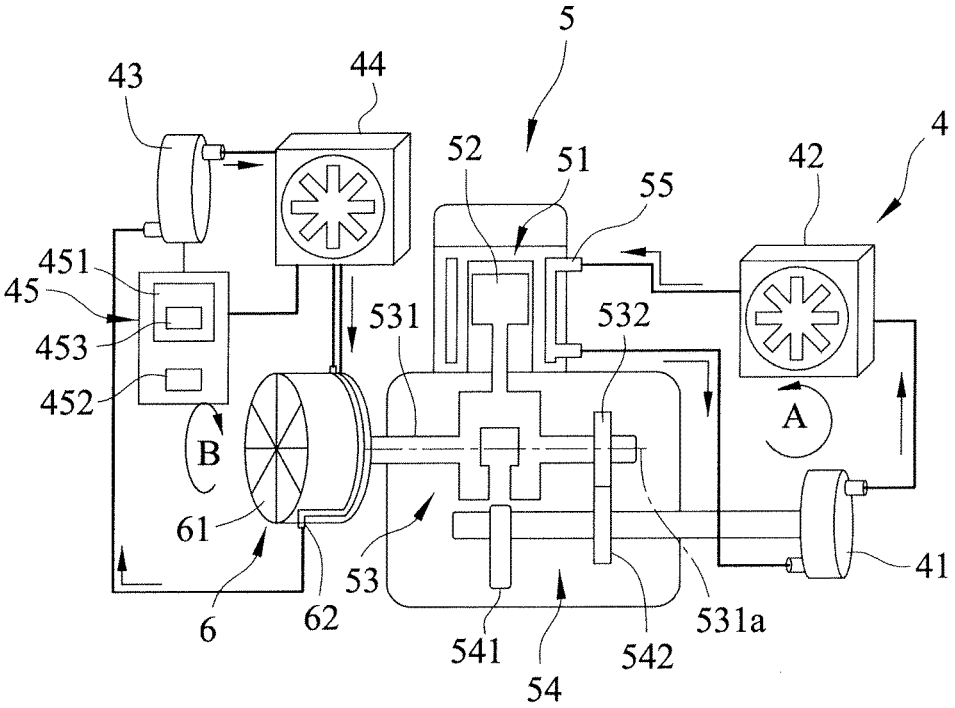
FIG. 5 is a schematic view of another variation of the cooling system of the embodiment.

FIG. 5 shows another variation of this embodiment. In this variation, the controlling unit 45 includes a controlling member 451, a temperature sensing member 452 and a timer 453. The timer 453 is integrated in the controlling member 451.

The temperature sensing member 452 detects the temperature of the generator 61 and emits a temperature signal to the controlling member 451 while the timer 453 emits a timing signal to the controlling member 451 according to the operation time of the generator 61. The controlling member 451 simultaneously receives the temperature signal from the temperature sensing member 452 and the timing signal from the timer 453 so as to control the turn-on time and the turn-off time and the rotational speed of the electrically controlled water pump 43. To be more specific, the timer 453 provides a fool-proofing effect. When the generator 61 is operated after a period of time, if the controlling member 451 does not receive the correct temperature signal from the temperature sensing member 452, the controlling member 451 can decide whether to turn on the electrically controlled water pump 43 depending on the timing signal emitted from the timer 453 according to the operation time of the generator 61. Therefore, by simultaneously receiving the temperature signal and the timing signal, the controlling member 451 is able to control the electrically controlled water pump 43 more precisely.

To sum up, since the electrically controlled water pump 43 can be directly and independently controlled by the controlling unit 45 so as to adjust the turn-on time and the turn-off time and the rotational speed thereof, the generator 61 can be maintained within the optimum working temperature range.

While the present invention has been described in connection with what is considered the most practical embodiment, it is understood that this invention is not limited to the disclosed embodiment but is intended to cover various arrangements included within the spirit and scope of the broadest interpretation and equivalent arrangements.

What is claimed is:

1. A vehicle, comprising:

an engine including a cylinder, a piston that is capable of moving upwardly and downwardly in said cylinder, a crankshaft unit that is driven by said piston, a balancing shaft unit that is driven by said crankshaft unit, and an engine cooling passage that is for cooling water to flow through;

a power generating system including a generator and a generator cooling passage; and a cooling system including a mechanical water pump that is driven by said crankshaft unit and that is in fluid communication with said engine cooling passage;

a first heat exchanger that is in fluid communication with said mechanical water pump and said engine cooling passage to constitute a first cooling circuit;

an electrically controlled water pump that is in fluid communication with said generator cooling passage;

a second heat exchanger that is in fluid communication with said electrically controlled water pump and said generator cooling passage to constitute a second cooling circuit, said first cooling circuit being not in fluid communication with said second cooling circuit; and a controlling unit that is electrically connected to said electrically controlled water pump and said generator to control operation of said electrically controlled water pump;

wherein said mechanical water pump and said first heat exchanger are disposed at a side of said engine, while said generator, said second heat exchanger and said electrically controlled water pump are disposed at an opposite side of said engine.

2. The vehicle as claimed in claim 1, wherein said crankshaft unit includes a crankshaft that has an axis, said mechanical water pump and said generator being respectively disposed at two opposite sides of said crankshaft along the axis.

3. The vehicle as claimed in claim 1, wherein said controlling unit includes a controlling member and a temperature sensing member for detecting temperature of said generator and emitting a temperature signal to said controlling member so that said controlling member is able to control turn-on time and turn-off time of said electrically controlled water pump depending on the temperature signal.

4. The vehicle as claimed in claim 3, wherein when said electrically controlled water pump is turned on, said controlling member further controls rotational speed of said electrically controlled water pump so as to adjust flow rate of cooling water in said electrically controlled water pump.

5. The vehicle as claimed in claim 1, wherein said controlling unit includes a controlling member and a timer for emitting a timing signal to said controlling member according to operation time of said generator so that said controlling member is able to control turn-on time and turn-off time of said electrically controlled water pump depending on the timing signal.

6. The vehicle as claimed in claim 3, wherein said controlling unit further includes a timer for emitting a timing signal to said controlling member according to operation time of said generator, said controlling member simultaneously receiving the temperature signal from said temperature sensing member and the timing signal from said timer so as to control the turn-on time and the turn-off time and rotational speed of said electrically controlled water pump.

7. The vehicle as claimed in claim 5, wherein said timer is integrated in said controlling member.

8. The vehicle as claimed in claim 6, wherein said timer is integrated in said controlling member.

9. The vehicle as claimed in claim 1, wherein:

said crankshaft unit includes a crankshaft and a first gear that is fixedly sleeved on said crankshaft;

said balancing shaft unit includes a balancing shaft and a second gear that is fixedly sleeved on said balancing shaft and that meshes with said first gear; and a tooth number of said first gear is the same as that of said second gear.

* * * * *